US006142001A

United States Patent [19]

Collier

[11] Patent Number: 6,142,001

[45] Date of Patent: Nov. 7, 2000

[54] CYLINDRICAL SHELL FOR USE IN GAS CYLINDER FABRICATION

[75] Inventor: John P. Collier, Franklin Lakes, N.J.

[73] Assignee: The BOC Group, Inc., New Providence, N.J.

[21] Appl. No.: 09/328,625

[22] Filed: Jun. 9, 1999

[51] Int. Cl.[7] ..... B21B 19/04

[52] U.S. Cl. ..... 72/97

[58] Field of Search ..... 72/97, 208, 209, 72/347, 348, 367.1, 368, 370.01

[56] References Cited

U.S. PATENT DOCUMENTS

| | | | |
|---|---|---|---|
| 2,349,570 | 5/1944 | Witter | 72/97 |
| 2,791,924 | 5/1957 | Sawyer | 72/97 |
| 5,778,714 | 7/1998 | Katsumura et al. | 72/97 |
| 5,964,117 | 10/1999 | Holroyd et al. | 72/258 |

FOREIGN PATENT DOCUMENTS

| | | | |
|---|---|---|---|
| 57-7305 | 1/1982 | Japan | 72/97 |

*Primary Examiner*—Rodney A. Butler
*Attorney, Agent, or Firm*—Salvatore P. Pace

[57] ABSTRACT

A method of producing a cylindrical shell in which a billet of circular, transverse cross-section is provided with of first and second sections formed of steel and a liner insert material, respectively. The first section has an end portion and a recess defined within the end portion. The second section is shaped to nest within the recess of the end portion of the first section. The billet is extruded into a cylindrical shell by a billet piercing operation so that the first section produces an outer cylindrical form and the second section produces a liner insert for the cylindrical form. The recess and therefore the second section (forming the liner insert) can be a frustum of a cone. The material for the liner insert may be a corrosion resistant nickel or nickel alloy, Hastalloy C-22, tantalum, titanium, gold or platinum.

6 Claims, 1 Drawing Sheet

CYLINDRICAL SHELL FOR USE IN GAS CYLINDER FABRICATION

BACKGROUND OF THE INVENTION

The present invention relates to a method of producing a cylindrical shell used for fabricating a gas cylinder to contain a gas. More particularly, the present invention relates to such a method in which a billet of circular, transverse cross-section is used to form the cylindrical shell by billet piercing. Even more particularly, the present invention relates to such a method in which the billet is formed of a first section of steel and a second section of liner material so that the cylindrical shell has an outer cylindrical form made of steel and an inner liner insert formed of the liner insert material.

Gas cylinders are widely used in various industries for storing gases. The storage of ultra-high purity gases used within the semiconductor industry is particularly problematical due their corrosive nature. Such corrosion can produce particulate contamination that in turn can produce unacceptable manufacturing defects. For instance, corrosive etching gases such as hydrogen chloride can corrode steel cylinders to produce particulate contaminants. If the resultant particulate material is drawn into a stage of the semiconductor manufacturing process, the product of such stage might be ruined.

Thus, gas cylinders have been specifically designed to maintain the purity of the gas by being fabricated of nickel. As may be appreciated, nickel gas cylinders are prohibitively expensive. Additionally, pure nickel cylinders generally cannot be used where the intended service pressure exceeds 35.15 kg./cm$^2$. As a result, gas cylinders for high purity gas storage applications are formed with an outer layer of steel for structural integrity and an inner nickel plating for corrosion resistance.

As has been indicated in U.S. Pat. No. 5,330,091, owned by the assignee herein, the electroplating a cylindrical shell of steel with nickel is not a recommended technique for fabricating gas cylinders intended for high purity storage applications because the plating can contain voids or cracks which can trap corrosion products of steel. Therefore, in this prior patent application, circular nickel and steel layers were bonded together by roll bonding or explosive cladding. The resultant two layer circular form is then used as a blank for a cold drawing process to produce the cylindrical shell used in forming the gas cylinder. In a cold drawing process, the blank is formed into a cup-like form with a mandrel and the cup-like form is then extruded by the mandrel, at room temperature, through a series of dies.

The drawback of the process disclosed in U.S. Pat. No. 5,330,091 is that it has not been found to be easily amenable toward the production of large gas cylinders. As will be discussed, the present invention provides a method of forming a seamless, steel cylindrical shell having a corrosion resistant lining that can be used to produce larger gas cylinder sizes than are obtainable by cold drawing production techniques.

SUMMARY OF THE INVENTION

The present invention provides a method of producing a cylindrical shell. In accordance with this method, a billet of circular, transverse cross-section is provided. The billet has first and second sections. The first section is formed of steel and has an end portion and a recess defined within the end portion. The second section is formed of a liner insert material that is shaped to nest within the recess of the end portion of the first section. The billet is billet pierced to form the cylindrical shell so that the first section produces an outer cylindrical form and the second section produces a liner insert for the cylindrical form.

The recess may have a conical side wall and the second section therefore can be a frustum of a cone. In any method in accordance with the present invention the liner insert material may be nickel. The liner insert may also be Hastalloy C-22, tantalum, titanium, gold or platinum.

Billet piercing, as used herein and in the claims, refers to a known method used in forming extruded cylindrical shells. In billet piercing, a billet, such as a billet in accordance with the present invention, is heated to a temperature of between about 1093° C., and about 1204° C. In a subsequent cupping operation, the heated billet is then pierced with a mandrel to form a cup. While still hot, the cup is further extruded through a series of dies by pressure of the mandrel The end result of the multiple extrusions is the cylindrical shell. The cylindrical shell is finished to form a gas cylinder by spinning the end of the shell into shoulder and neck regions. The cylinder is then thermally treated and then quenched and tempered.

The billet piercing operation is to be contrasted with prior art cold drawing methods in which disk-shaped plates containing layers of steel and nickel are drawn through dies at room temperature. Again, the problem with the drawing is that finished gas cylinder size is limited to about 21 liters. Larger, 43 liter gas cylinders cannot be cold drawn economically.

One might imagine then that simply forming a billet in two sections, steel and nickel, akin to the circular blank used in a cold deep drawing process would result in a cylindrical shell that could be spun into a gas cylinder. The inventor herein has found that the problem with forming a cylindrical shell in such a manner is the thickness of nickel in the cylinder wall dramatically increases towards the top of the cylindrical shell while the thickness of steel decreases. The reason for this is that the nickel or other liner insert materials during the piercing operation will flow faster than the steel. It is the steel, however, that adds sufficient structural integrity to the finished gas cylinder to allow for pressurization. It has been found that nesting the nickel within the steel billet will provide a greater uniformity of steel and nickel thickness so as to allow the cylindrical shell to be used for its intended purpose.

BRIEF DESCRIPTION OF THE DRAWINGS

While the specification concludes with claims distinctively pointing out the subject matter that applicants regard as their invention, it is believed that the invention will be better understood when taken in connection with the accompanying drawings in which:

DETAILED DESCRIPTION

Figure 1:
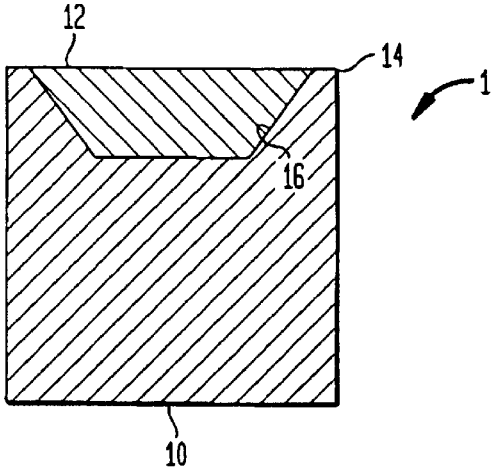
FIG. 1 is a cross-sectional view of a billet used in carrying out a method in accordance with the present invention.

With reference to FIG. 1, a billet 1 for carrying out a method in accordance with the present invention is illustrated. Billet 1 has a circular, transfer-cross-section and is formed of first and second sections 10 and 20. Section 10 is fabricated from 4130 steel and has an end portion 14 provided with a recess 16 defined within end portion 14. Second section 12 is formed of a liner insert material which is shaped to nest within recess 16 of end portion 14. In gas cylinder used to retain specialty gases, the liner insert material is a corrosive resistant nickel or nickel alloy. Liner insert materials of Hastalloy C-22, tantalum, titanium, gold, or platinum are possible. As illustrated, recess 16 has a conical side wall and thus, second section 12 is a frustum of a cone to nest within recess 16. Other shapes are possible, such as hemispherical shapes.

Figure 2:
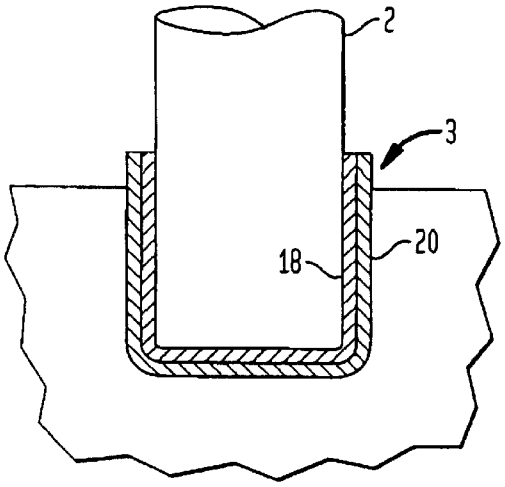
FIG. 2 is a cross-sectional view of the billet shown in FIG. 1 after completion a cupping operation.
Figure 3:
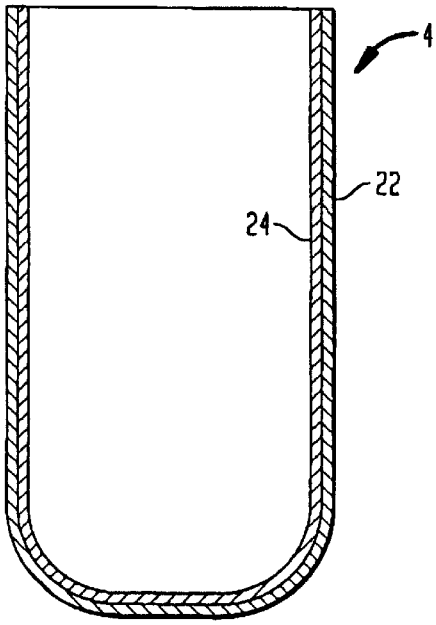
FIG. 3 is a cross-sectional view of a cylindrical shell extruded from the billet shown in FIG. 1.
Figure 4:
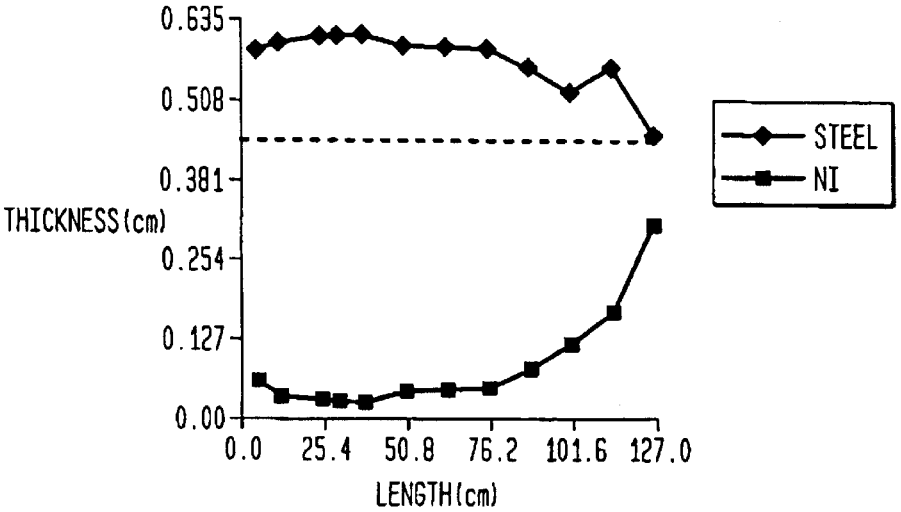
FIG. 4 is a graph of nickel and steel thickness vs. cylindrical shell length of the cylindrical shell shown in FIG. 3.

A series of billet dimensions were modeled using finite element techniques. FIGS. 2 through 4 represent the results of modeling a billet 1 with a height of about 22.86 cm and a diameter of about 20.32 cm. Second layer 12 was modeled as nickel with a thickness of about 5.08 cm, a top surface diameter of about 17.78 cm and a bottom surface diameter of about 15.24 cm.

With specific reference to FIG. 2, billet 1 has been pierced by a mandrel to produce a cup-like form 3. Cup-like form 3 has an inner layer of nickel 18 derived from liner insert material 12 and an outer portion 20 that is derived from first section 10 of steel.

With reference to FIGS. 3 and 4, a cylindrical shell 4 has been formed from cup-like form 3 with an outer cylindrical form 22 that has been derived from outer portion 20 of the cup-like form 3 and a liner insert 24 derived from the inner layer of nickel 18 thereof. As illustrated in FIG. 4, although the nickel thickness increases toward the top of cylindrical shell 4, the steel retains a minimum transverse thickness that is greater than the minimum allowable wall thickness for a 141.7 kg/cm$^2$ cylinder under applicable Department of Transportation regulations of the United States. In FIG. 4, the minimum transverse allowable wall thickness is shown by the dashed line and the length of the cylindrical shell 4 is measured from the closed to the open end or from bottom to top as viewed in FIG. 4.

Various billet shapes were modeled. For instance, billets having about a 17.78 cm diameter top surface and about a 10.16 cm diameter bottom surface and billets having about a 15.24 cm diameter top surface and about a 10.16 cm bottom surface. In all cases, the diameter of the steel remained at about 20.32 cm. The modeling indicated that decreasing the diameter of the bottom surface, for instance, from about 15.24 cm to about 10.16 cm, without changing the top surface diameter had only a modest effect on layer uniformity. Reducing the diameter on the bottom surface produced slightly more uniform nickel and steel layers. Reducing the diameter on the top surface of the nickel from about 17.78 cm to about 15.24 cm had a much greater effect on layer uniformity.

While the present invention has been described with reference to a preferred embodiment, as will occur to those skilled in the art, numerous changes, additions and omissions may be made without departing from the spirit and scope of the present invention.

I claim:

1. A method of producing a cylindrical shell, said method comprising:

forming a billet of circular, transverse cross-section;

the billet formed of first and second sections, the first section formed of steel and having an end portion and a recess defined within said end portion and the second section formed of a liner insert material shaped to nest within said recess of said end portion of said first section; and billet piercing said billet into said cylindrical shell so that said first section produces an outer cylindrical form and said second section produces a liner insert for said cylindrical form.

2. The method of claim 1, wherein said recess has a conical sidewall and said second section is a frustum of a cone.

3. The method as claimed in claim 1 further comprising spinning the end of said cylindrical shell into shoulder and neck regions.

4. The method as claimed in claim 1 wherein said outer cylindrical form and said liner insert are of uniform thickness.

5. The method of claim 1 or claim 2 wherein said liner insert material is nickel or a nickel alloy.

6. The method of claim 1 or claim 2 wherein said liner insert material is Hastalloy C-22, tantalum, titanium, gold or platinum.

* * * * *